US008480112B2

(12) United States Patent
Holzer et al.

(10) Patent No.: US 8,480,112 B2
(45) Date of Patent: Jul. 9, 2013

(54) SKI OR SNOWBOARD WITH A BOARD-LIKE FORCE-TRANSMITTING ELEMENT

(75) Inventors: Helmut Holzer, St. Johann (AT); Rupert Huber, Radstadt (AT)

(73) Assignee: Atomic Austria GmbH (AT)

( * ) Notice: Subject to any disclaimer, the term of this patent is extended or adjusted under 35 U.S.C. 154(b) by 655 days.

(21) Appl. No.: 12/635,881

(22) Filed: Dec. 11, 2009

(65) Prior Publication Data

US 2010/0148457 A1 Jun. 17, 2010

(30) Foreign Application Priority Data

Dec. 11, 2008 (AT) ..... A 1930/2008

(51) Int. Cl.
*A63C 9/00* (2006.01)

(52) U.S. Cl.
USPC ..... 280/602; 280/607; 280/608

(58) Field of Classification Search
USPC ..... 280/601, 602, 607, 608, 609, 610, 280/617, 11.14, 11.18, 845, 14.21, 25
See application file for complete search history.

(56) References Cited

U.S. PATENT DOCUMENTS

| | | | | |
|---|---|---|---|---|
| 5,788,259 | A * | 8/1998 | Emig | 280/609 |
| 5,944,336 | A * | 8/1999 | Fagot | 280/607 |
| 6,079,731 | A * | 6/2000 | Emig et al. | 280/607 |
| 6,131,939 | A * | 10/2000 | Fels | 280/601 |
| 6,217,055 | B1 * | 4/2001 | Silva | 280/607 |
| 6,955,374 | B2 * | 10/2005 | Stefanova et al. | 280/602 |
| 7,011,332 | B2 * | 3/2006 | Zanco | 280/602 |
| 7,134,680 | B2 * | 11/2006 | Emig et al. | 280/602 |
| 7,264,262 | B2 * | 9/2007 | Zanco | 280/602 |
| 7,360,782 | B2 * | 4/2008 | Gignoux | 280/602 |
| 7,419,179 | B2 | 9/2008 | Zanco et al. | |
| 7,513,509 | B2 * | 4/2009 | Guyot et al. | 280/11.14 |
| 7,967,324 | B2 * | 6/2011 | Miette et al. | 280/618 |
| 2005/0104328 | A1 | 5/2005 | Emig et al. | |
| 2006/0012150 | A1 | 1/2006 | Zanco et al. | |
| 2008/0185818 | A1 | 8/2008 | Riepler et al. | |
| 2010/0237588 | A1 * | 9/2010 | Krause et al. | 280/608 |

FOREIGN PATENT DOCUMENTS

| | | | |
|---|---|---|---|
| AT | 504800 | A1 | 8/2008 |
| DE | 69101217 | T2 | 6/1994 |
| DE | 10204300 | A1 | 8/2003 |
| DE | 10204330 | A1 | 8/2003 |
| DE | 602005005901 | T2 | 5/2009 |
| EP | 0490043 | A1 | 6/1992 |
| EP | 1616602 | A1 | 1/2006 |
| WO | 0010659 | A1 | 3/2000 |

* cited by examiner

*Primary Examiner* — John Walters
*Assistant Examiner* — Brian Swenson
(74) *Attorney, Agent, or Firm* — Lerner, David, Littenberg, Krumholz & Mentlik, LLP

(57) ABSTRACT

A ski or a snowboard in the form of a board-like sliding device, comprising a multi-layered sliding board body and at least one board-like force-transmitting element supported on the top side of the sliding board body, the upper side of which force-transmitting element is provided for supporting a binding device for a potentially releasable connection with a sports shoe. In at least one of the two lateral upper edge sections of the sliding board body running in the longitudinal direction of the sliding board body at least one interlocking coupling means is formed. Said at least one interlocking coupling means is formed by at least one physically independent strip or profile-like coupling element which is arranged between the board-like force-transmitting element and the sliding board body and is provided for forming an interlocking connection between the board-like force-transmitting element and the sliding board body.

17 Claims, 3 Drawing Sheets

SKI OR SNOWBOARD WITH A BOARD-LIKE FORCE-TRANSMITTING ELEMENT

In accordance with 35 U.S.C. §119, the applicants claim the priority of Austrian patent application No. A 1930/2008 of 11 Dec. 2008.

BACKGROUND OF THE INVENTION

1. Field of the Invention

The invention relates to a ski or a snowboard in the form of a board-like sliding device, as indicated in claim 1.

2. Prior Art

U.S. Pat. No. 7,419,179 B2 describes a board-like winter sports device in the form of a ski, monoski or snowboard, in which the sliding board body provided for sliding on a surface comprises in its lateral, upper edge sections respectively a cut-out that is open at least towards the top, in which a rod or strip-like element is mounted respectively. These lateral, strip-like elements extend at least inside the binding assembly zone and over at least 30% of the length of the sliding board body. The two lateral, strip-like elements are joined together via a transverse web positioned in the middle section of the strip-like elements. According to an alternative embodiment two transverse webs are provided, which are positioned at a distance in front of the distal ends of the strip-like elements. On said lateral, strip-like elements a one or two-piece binding plate is supported for securing the jaw bodies of a ski binding. Said binding plate does not extend over the front and rear end of the ski binding. During the bending of the sliding board body the two lateral strip-like elements tend to increase their distance from one another. In particular, there is a tendency that mainly the distal ends of the strip-like elements slide laterally out of the mounting depressions upon the extreme bending of the sliding board body. A sufficient degree of stability or robustness of this structure is thus only achievable with relatively rigid or stable, strip-like elements, which can however have a disadvantageous effect on the bending characteristic of the entire construction.

In AT 504 800 A1, by the same applicant, a generic, board-like sliding device is disclosed. In this case a board-like force-transmitting element is provided which is supported on the top side of the actual sliding board body. The top side of the board-like force-transmitting element is provided for supporting a binding device for possible detachable connection with a sports shoe. At least in the region of the binding assembly zone between the bottom side of the plate like force-transmitting element and the top side of the sliding board body at least one interlocking connection is provided, which is formed by integrally designed, strip and/or projection-like elevations and corresponding groove-like depressions. Said interlocking connection is positioned close to the longitudinal middle axis of the sliding board body, in particular in alignment with the fastening screws for the assembly of elements of the binding device. By means of this at least one, longitudinally centrally positioned interlocking connection between the bottom side of the board-like force-transmitting element and the top side of the sliding board body rotational movements between the board-like force-transmitting element and the sliding board body could be reliably prevented relative to a vertical axis, but the transmission of forces inside the binding assembly zone relative to loads directed vertically to the running surface was only satisfactory to a limited degree.

The underlying problem of the present invention is to create a ski or a snowboard, which has improved driving properties, the achievable performance of such a sliding board body being as high as possible. In particular the behaviour on curves is to be improved.

OBJECTIVES AND ADVANTAGES OF THE INVENTION

The problem of the invention is solved by means of a board-like sliding device according to the features in claim 1. It is essential that the ski according to the invention or the snowboard according to the invention has significant advantages with regard to it driving properties over the board-like sliding devices known from the prior art. In particular, a ski or snowboard is created, whose vibrational behaviour and thus also the driving behaviour of which is influenced significantly by the board-like force-transmitting element, whereby the winter sports devices according to the claims mainly achieve excellent edge gripping and steering stability, which is especially important when negotiating curves or for a precise swinging operation. In particular, the given, board-like force-transmitting element gives the sliding board body exactly the stability and strength required to set cut or so-called "carved" swings in the snow in a reliable and controllable manner. The claimed board-like sliding device thus provides the user with the required, sufficiently high stability and ensures that the claimed sliding device has a high degree of control and guiding stability. Mainly, with the increasing loading of the sliding device during a swinging phase, the sliding board body in contact with the ground is prevented from giving way unexpectedly or bending and behaviour of the board-like sliding device that is difficult to control is also prevented. In particular, within a relatively high loading area of the sliding board body a harmonious or identical swing guiding can be achieved, by means of which also personal safety is increased when using the sliding board body according to the invention. The given, board-like force-transmitting element thus stabilises the sliding board modified according to the invention such that a good degree of control or favourable guiding behaviour can be achieved. In particular, the board-like force-transmitting element suppresses or reduces in at least one end section of the sliding board body high frequency vibrations in a direction vertical to the running surface coating, which is an advantage mainly for moving fast on relatively rough pistes, in particular when negotiating a curve. Furthermore, it is an advantage that the forces applied by the user or the control movements introduced by the user can be introduced with the interconnection of the force-transmitting element in exactly those sections of the sliding board body, in which the board-like force-transmitting element can have the most or best effect relative to the sliding board body.

A particular advantage of the claimed embodiment is that the mechanical coupling between the board-like force-transmitting element and the underlying, actual sliding board body is based not only on at least one screw connection, and that the at least one interlocking coupling means is also used for transmitting control or steering forces between the board-like force-transmitting element and the sliding board body—and vice versa. In this way the number of screwing means used can be reduced or by means of relatively delicate acting screwing means an extremely stable coupling transmitting the respective forces as smoothly as possible between the board-like force-transmitting element and the sliding board body can be obtained. Since the at least one interlocking coupling means is formed in the upper edge sections of the sliding board body relatively directly above the control or steel edges of the sliding board body, the effect of these control edges can be influenced to a certain degree by means of the at least one interlocking coupling means. Thus it is also possible in a simple manner, depending on the interlocking coupling means used, to vary or determine the control behaviour of the board-like sliding device or the tracking or grip of the control edges relative to the respective surface, in particular relative to ice or snow, within certain influence limits. This is achieved on the one hand by the structurally independent design of the at least one interlocking coupling element, as in this way in terms of production technology a greater range of models or types can be obtained relatively easily. In addition, the at least one interlocking coupling means can be adapted relatively precisely and inexpensively to the respective requirements and demands.

By way of the measures according to claim 2 an elastic bending or rebounding of the sliding board body is ensured that is unhindered as far as possible, so that the latter can achieve an optimum bending resistance characteristic. Since the corresponding interlocking coupling prevents lateral variation movements between the board-like force-transmitting element and the sliding board body at right angles to its longitudinal axis and substantially parallel to its running surface, the respective control or reaction forces of the user can be transmitted instantly and directly to the control edges of the sliding board body, thereby improving its performance or control behaviour.

By means of the design according to claim 3 an optimal interlocking coupling is formed between the board-like force-transmitting element and the sliding board body. The at least one coupling element thus represents the so-called spring inside the interlocking connection designed in the manner of a groove-spring-groove connection between the board-like force-transmitting element and the actual sliding board body.

A configuration according to claim 4 is also advantageous, as in this way the longitudinal guiding function is maintained between the board-like force-transmitting element and the sliding board body, and the assembly of the board-like force-transmitting element onto the sliding board body can be simplified.

Also by way of the measures according to claim 5 the longitudinal displaceability between the board-like force-transmitting element and the sliding board body can be ensured and it is possible to facilitate the assembly with regard to the interlocking connection between the board-like force-transmitting element and the sliding board body.

By way of the measures according to claim 6 a simple control option is provided or a control window is created, by means of which the presence or the characteristic of a coupling element can be checked visually. In addition, in the case of using coupling elements with various different mechanical or dynamic properties, it can be checked instantly which type of coupling element is being used between the board-like force-transmitting element and the sliding board body.

By way of the measures according to claim 7 the cost of assembly and components for creating the ski or snowboard according to the invention can be kept as low as possible, thereby minimising the manufacturing costs. Furthermore, in this way a structurally relatively simple longitudinal guide is created, which can efficiently absorb displacement forces aligned perpendicular to the longitudinal direction of the sliding board body and substantially parallel to its running surface.

By way of the measures according to claim 8 in a simple manner the range of types and models can be increased considerably. In particular, at a relatively low production or total cost a plurality of skis or snowboards can be produced with various different characteristics, in order to accommodate the respective requirements or needs as far as possible. In particular, in a simple manner the mechanical coupling, in particular the stability of the connection between the board-like force-transmitting element and the sliding board body can be changed by means of the at least one interlocking coupling element or can be determined according to the model within defined limits.

Also by way of the measures according to claim 9 an increased range of types and models is made possible in a simple manner. In particular, in this way model ranges can be created which are adapted to the respective requirements or demands, without requiring expensive new constructions or the adaptation of technical production procedures. The total costs can thus be kept as low as possible despite the increased range of models or types.

By way of the measures according to claim 10 a particularly simple, visual check of the behaviour or mechanical properties of the respective coupling element or the associated characteristics of the ski or snowboard can be made. A particular advantage is also that the respective check can be performed in a particularly reliable manner, as by means of a generally familiar colour allocation it allows an intuitive verification of the respective characteristics of various coupling elements. In particular, by means of defined colour allocations relating to brightness or shade it can be decided whether the coupling elements are relatively resistant to pressure or are flexible or relatively rigid or bendable, since the respective coupling elements can be recognised intuitively and identified without difficulty.

By way of the measures according to claim 11 in the area in which the greatest load occurs relative to the ground surface, a highly-stable mechanical coupling is created, which is an advantageous for the robustness or stability of the ski or snowboard.

By way of the measures according to claim 12 the influence of the at least one coupling element can be varied from marginal to relatively significant or adjusted to the respective requirements.

By way of the design according to claim 13 a mechanical coupling that is as play-free or tight as possible between the board-like force-transmitting element and the sliding board body can be achieved in relation to displacement tendencies aligned at right angles to the longitudinal direction of the sliding board body.

By way of the measures according to claim 14 shearing or abrasion tracks between the strip or rod-like coupling element and the sliding board body and/or the bottom side of the board-like force-transmitting element are largely avoided. Furthermore, in this way as far as possible a non-jamming mechanical longitudinal guide is created between the said elements.

By way of the measures according to claim 15 a high transverse stability can be achieved between the board-like force-transmitting element and the sliding board body, said increased transverse stability being bidirectional. Furthermore, in this way the characteristics of a ski can be adjusted according to its use as an internal or external ski, in particular depending on the change in use as a mountain or valley ski, to the respective radius ratios between mountain and valley skiing.

By way of the measures according to claim 16 the effort of assembly can be reduced. In addition, an increased dimensional stability is achieved with regard to the distance between the two coupling elements running parallel to one another. In particular, even after a comparatively long or rough period of use as far as possible the constant action of at least one coupling element is ensured.

A development according to claim 17 and/or 18 is also particularly advantageous, as thereby the relative displacements between the board-like force-transmitting element and the sliding board is opposed in relation to the longitudinal direction of the sliding board body. In particular, these relative displacements are cushioned and delimited gradually after covering a defined relative displacement path. This path delimitation is dependent on the load or forces. Mainly, if the deformation force is no longer adequate to overcome the elastic deformation resistance, a relative movement dependent on the bending between the board-like force transmitting element and the sliding board body is gradually stopped.

BRIEF DESCRIPTION OF THE DRAWINGS

For a better understanding of the invention the latter is explained in more detail with reference to the following figures.

In a much simplified schematic view.

DETAILED DESCRIPTION OF PREFERRED EMBODIMENTS

Figure 1:
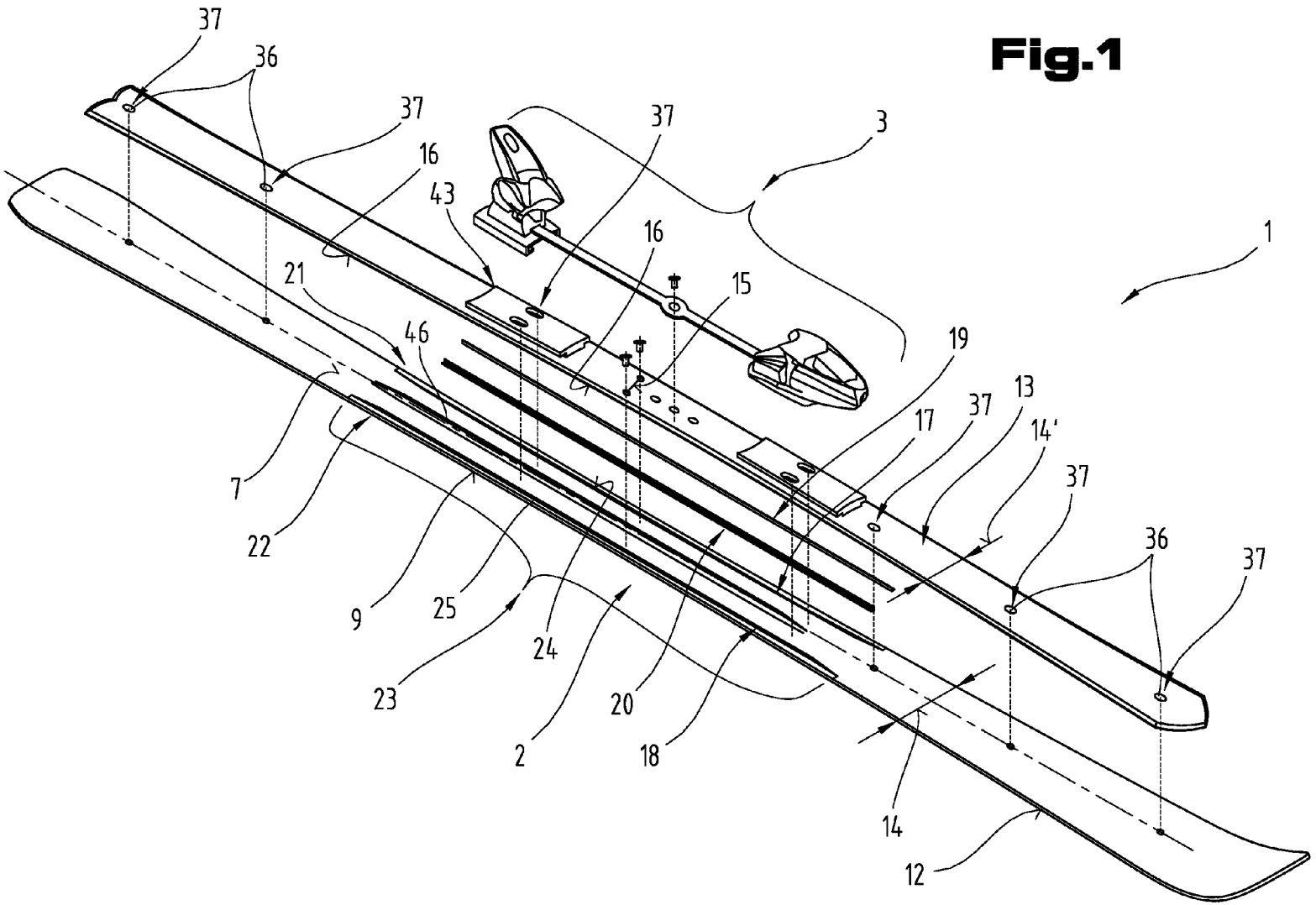
FIG. 1 shows a board-like sliding device, in particular a ski, comprising a top and a bottom plate or board-like body in a partially exploded view.

First of all, it should be noted that in the variously described exemplary embodiments the same parts have been given the same reference numerals and the same component names, whereby the disclosures made throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

FIGS. 1 to 4 show schematically a preferred embodiment of a board-like sliding device 1 with improved driving properties, in particular significant damping or cushioning properties. In particular, a ski 2 is shown schematically, the sliding or curve behaviour of which and the inherent dynamics of which are advantageous for a plurality of users, whereby in these Figures only the most essential components are shown by way of example. Furthermore, in the individual Figures only the most essential part components are shown, in particular the sliding board basic body and the plate-like force-transmitting element.

Preferably, the board-like sliding device 1 is formed by a ski 2 or by a snowboard. As already known such a ski 2 is used in pairs, whereas the user of a snowboard is supported on both feet on a single sliding board body. To connect the feet of the user to the sliding device 1 the latter comprises at least one binding device 3, which can be designed as a safety-release binding or as an inflexible coupling binding.

The board-like sliding device 1 is designed in the manner of a sandwich or monocoque construction. This means that a plurality of layers are joined together by adhesive and form the one-piece basic body of the sliding device 1. In a known manner said layers form at least one strength-related upper strap 4, at least one strength-related lower strap 5 and at least one core 6 arranged in between. The upper strap 4 and/or the lower strap 5 can be formed from at least one plastic layer and/or metal layer and/or fibre layer and/or epoxy resin layer or the like. The core 6 can—as already known—be made of wood and/or foamed plastic. The core 6 thus substantially spaces apart the strength-relevant upper strap 4 from the strength-relevant lower strap 5 of the sliding device 1.

The top side 7, i.e. the top outer surface of the sliding device 1, is formed by a cover layer 8, which mainly has a protective and decorative function. The bottom side 9, i.e. the bottom surface of the sliding device 1, is formed by a running surface coating 10, with good sliding properties relative to the ground, in particular relative to snow and ice. The cover layer 8 can also extend at least in sections over the side cheeks of the board-like sliding device 1 and together with the running surface coating 10 form a box-like structure, as can be taken mainly from the cross sectional view according to FIG. 4.—The side edges of the running surface coating 10 are preferably delimited by control edges 11, 12, preferably made of steel, to enable even on a relatively hard surface a very precise and largely non-slip guiding of the sliding device 1. The control edges 11, 12 essential for the control or guiding of the sliding device 1—FIG. 5—are rigidly connected with the structure, in particular with the running sole or the lower strap 5 of the sliding device 1. Preferably, the control edges 11, 12—as already known—are secured in an interlocking manner in the sliding device construction. Similarly, the running surface coating 10 is securely connected over its entire flat side facing the core 6 with the sliding device construction, in particular with its lower strap 5. Preferably, the running surface coating 10 is adhered over the entire surface to the surrounding structural elements of the sliding device 1.

The structure described above determines to a significant degree the strength, in particular the bending behaviour and the torsional resistance of the board-like sliding device 1. Said strengths are predetermined or pregiven by the materials and layer thicknesses used and by the joining methods used. It is essential that on the top side 7 of the actual sliding board body a board-like force-transmitting element 13 is supported at least in sections in a force or load-transmitting manner. A structurally predefined shaping or lateral form of the sliding device 1 provides a width 14 or 14' of the sliding device 1 and/or of the board-like force-transmitting element 13 which can vary over the longitudinal direction of the sliding device 1, as can best be seen from FIGS. 2, 3. According to an advantageous embodiment in addition to the actual sliding board body—FIG. 2—also the board-like force-transmitting element 13 has a shaping, which is formed in particular by curved indentations on the longitudinal side edges of the board-like force-transmitting element 13, so that in a plan view of the board-like force-transmitting element 13 it has a substantially concave contour. The shaping or the lateral shape of the board-like force-transmitting element 13 is thus designed to be almost identical or substantially identical to the shaping or lateral shape of the sliding board body, as illustrated by way of example in FIG. 3. A width 14'—FIG. 1—of the board-like force-transmitting element 13 is however preferably selected to be smaller in all longitudinal sections than the corresponding width 14 of the sliding board body in the same or congruent longitudinal section. Preferably, the board-like force-transmitting element 13 does not project over the longitudinal side edges of the sliding board body. In this way despite a highly-effective, board-like force-transmitting element 13 a high degree of personal or injury safety is achieved for the sliding device 1.

Figure 3:
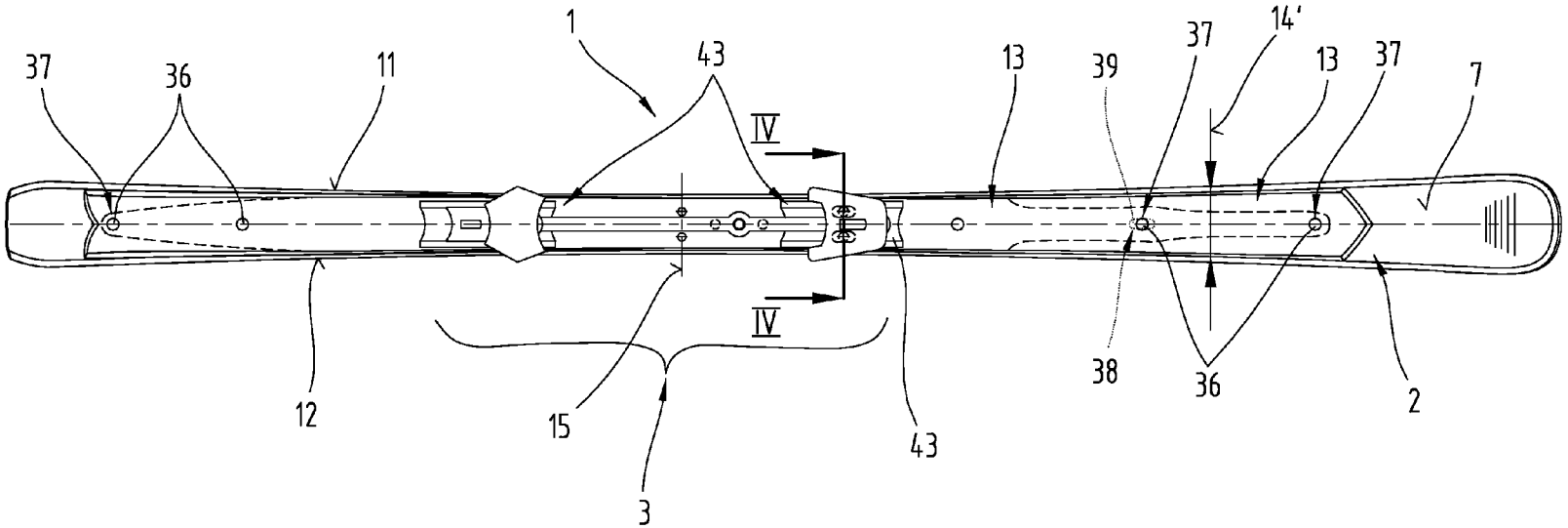
FIG. 3 shows the board-like sliding device according to FIG. 1 in the assembled state in a view from above.

According to an alternative embodiment the board-like force-transmitting element 13 can also be designed to taper in a wedge-shape or step-shape relative to at least one of its distal end sections, as indicated by way of example in FIG. 3 by dashed lines.

In particular, by means of the board-like force-transmitting element 13 significant changes in the driving behaviour, mainly concerning the sliding behaviour and the inherent dynamics or the so-called "rebound", can be obtained after removing load from the sliding device 1, as occurs in particular when exiting from a curve, without structurally complex or expensive means or measures having to be taken that significantly increase the weight of the ski 2. The suitably changed driving behaviour of such a ski 2 is also clearly noticeable for users with average skills and also for users who only ski occasionally. Thus the acceptance of use can be increased and the pleasure of using such skis 2 can be increased significantly.

Preferably, the board-like force-transmitting element 13 extends from the binding assembly section in the direction of the rear end section and in the direction of the front end section of the sliding board body, as can be seen best from the drawings in FIGS. 1 and 3. This makes it possible to change significantly or strongly influence the driving behaviour of the sliding board body by means of the board-like force-transmitting element 13.

The distal ends of the force-transmitting element 13 move relative to the top side 7 of the sliding board body in its longitudinal direction, so that relative displacements between the force-transmitting element 13 and the sliding board body are possible, if the corresponding sliding device 1 is subjected to bending or rebounding.

Figure 4:
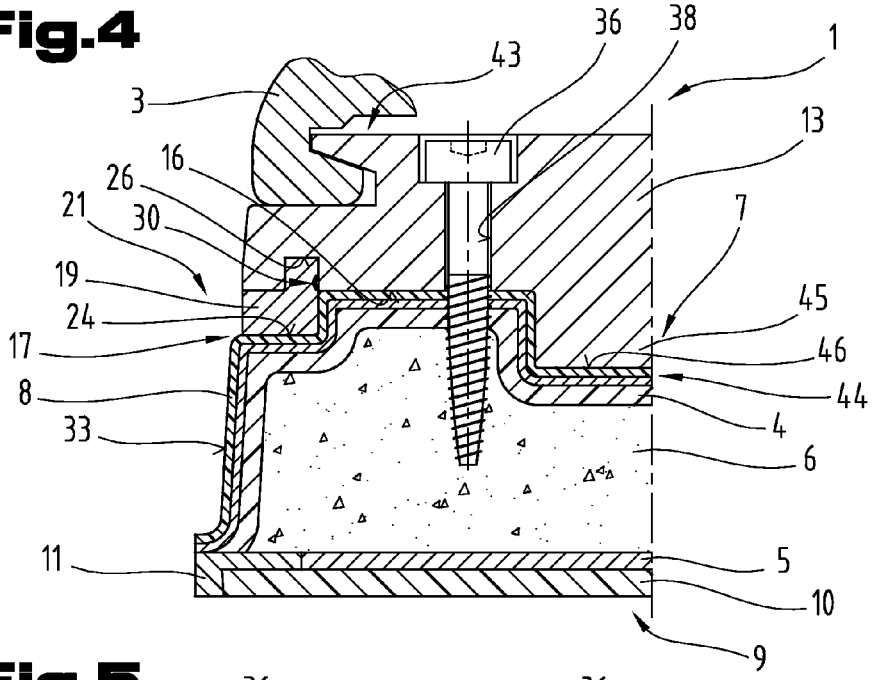
FIG. 4 shows a cross section of the board-like sliding device according to FIG. 1 in a section with mutual interconnection by a coupling element.

As can best be seen from FIG. 4, the cover layer 8 of the sliding board body is preferably made as a plastic layer, which is decorated on at least one side. Said cover layer 8 thus forms the main part of the top side 7 of the sliding board body. Preferably, this cover layer 8 also covers at least parts of the outer longitudinal side walls as can best be seen from FIGS. 4, 5.

The board-like force-transmitting element 13 is supported in its longitudinal extension at least in parts on the top side 7 of the sliding board body in a load or force-transmitting manner. According to the embodiment shown the bottom side of the board-like force-transmitting element 13 is supported almost over the whole surface on the top side 7 of the sliding board body. Alternatively, it is also possible to provide on the bottom side of the board-like force-transmitting element 13 individually arranged support zones opposite the top side 7 of the sliding board body. In this case the support zones are positioned at least in the end sections of the force-transmitting element 13, such that the board-like force-transmitting element 13 is supported at least in its end sections in a load and force-transmitting manner on the underlying sliding board body.

To obtain advantageous effects it is expedient if the board-like force transmitting element 13 extends from a binding assembly centre point 15 provided by the manufacturer of the sliding board body over more than 50% of the length up to the rear end of the sliding board body and at the same time extends over more than 50% of the length up to the front end of the sliding board body. It is preferable, if the force-transmitting element 13 extends roughly over 51% to about 96%, preferably over 66% to 86% of the projected length of the sliding board body. The projected length is considered to be the length of the sliding board body in a view from above. The longitudinal extension of the board-like force-transmitting element 13 is substantially limited in that the board-like force-transmitting element 13 should not extend in the upwards bending blade section or end section of the sliding board body, so as not to restrict relative displacements between the ends of the board-like force-transmitting elements 13 and the sliding board body, if said leaf-spring-like packet of force-transmitting element 13 and sliding board body is subjected to downwards bending or lifting of the binding assembly section or middle section relative to the end sections. In particular, the upwardly bent blade section of the sliding board body would lock relative to the end face of the board-like force-transmitting element 13 or inhibiting forces would occur, if the board-like force-transmitting element 13 were to extend in a straight or curved line into the blade section of the sliding board body. Particularly, if the board-like force-transmitting element 13 extends over two thirds up to nine tenths, for example over about three quarters of the length of the sliding board body between the binding assembly centre point 15 and the respective end of the sliding board body or relative to the total length of the sliding board body, a good ratio can be achieved between weight optimisation and the stability or functionality of the entire sliding device 1.

As can best be seen from FIGS. 1 and 3, the board-like force-transmitting element 13 is provided for load-transmitting support, in particular for assembling a binding device 3 for the shoe of a user. In particular, on the top side of the board-like force transmitting element 13 a binding device 3 is secured in a known manner. The binding device 3 can comprise in a known manner a toe and heel jaw, which are connected either directly or with the intermediary of a guiding rail arrangement to the top side of the board-like force-transmitting element 13. The binding device 3 is thus supported with the interconnection of the board-like force-transmitting element 13 relative to the actual sliding board body.

As can best be seen from an overview of FIGS. 1 and 4, it is expedient to provide an interconnecting coupling means 17, 18 between the bottom side 16 of the board-like force-transmitting element 13 and the top side 7 of the sliding board body. Said interconnecting, preferably pair of coupling means 17, 18 between the bottom side 16 of the board-like force-transmitting element 13 and the top side 7 of the sliding board body extends substantially in an assembly zone for the binding device 3, as shown best in FIG. 1. In said assembly zone for a binding device 3 the sliding board body has its greatest thickness, as seen in FIG. 4, which enables the provision of a sufficiently defined, mutual interlocking or engagement between the board-like force-transmitting element 13 and the sliding board body, as illustrated by way of example in FIG. 4.

The interconnecting coupling means 17, 18 is thus designed such that it allows mutual longitudinal displacements and balancing relative movements between the force-transmitting element 13 and the sliding board body in the longitudinal direction of the sliding board body, if the sliding board body and the board-like force-transmitting element 13 are subjected to bending, as occurs for example when moving over troughs. The interconnecting coupling means 17, 18 is designed such that it prevents as far as possible relative displacements between the force-transmitting element 13 and the sliding board body perpendicular to the longitudinal extension and substantially parallel to the running surface coating 10 of the sliding board body and such displacement tendencies are resisted. This means that the at least one interlocking coupling means 17, 18 allows relative displacements between the board-like force-transmitting element 13 and the sliding board body in longitudinal direction of the sliding board body, but prevents lateral deviation movements between the board-like force-transmitting element 13 and the top side 7 of the sliding board body, as can be seen clearly from an overview of FIGS. 1 and 4. Said partially acting interconnection between the board-like force-transmitting element 13 and the sliding board body thus facilitates as far as possible a direct or instantaneous transmission of forces between the board-like force-transmitting element 13 and the sliding board body, without the sliding board body being blocked in its bending behaviour by the board-like force-transmitting element 13.

The interconnecting coupling means 17, 18 is preferably formed by at least one independently formed, i.e. structurally separate, strip or profile-like coupling element 19, 20. This at least one strip or profile-like coupling element 19, 20 is arranged between the board-like force-transmitting element 13 and the sliding board body to establish an interlocking connection between the board-like force-transmitting element 13 and the sliding board body. The at least one structurally independent coupling element 19, 20 thus represents a coupling means for producing an interlocking connection between the board-like force-transmitting element 13 and the underlying sliding board body.

It is also essential that the at least one interlocking coupling means 17, 18, in particular its at least one strip- or profile-like coupling element 19, 20, is formed in at least one of the two lateral, longitudinal, upper edge sections 21, 22 of the sliding board body. In particular, at least one strip- or profile-like coupling element 19, 20 is formed in at least one edge section 21, 22 closest to the top side 7 of the sliding board body. Preferably, on both lateral, upper edge sections 21, 22 at least one strip- or profile-like coupling element 19, 20 is provided, as illustrated in FIG. 1.

According to an advantageous embodiment the at least one structurally independent coupling element 19, 20 extends in relation to its longitudinal direction in a binding assembly zone 23 and is thus inserted or mounted between the bottom side 16 of the force-transmitting element 13 and the top side 7 of the sliding board body, as can be seen in an overview of FIGS. 1 and 4. In particular, the at least one coupling element 19, 20 is embedded in an interlocking manner at least partly or at least in sections between the bottom side 16 of the force-transmitting element 13 and the top side 7 of the sliding board body. The at least one coupling element 19, 20 is in this case formed for mutual guiding between the force-transmitting element 13 and the sliding board body relative to the longitudinal direction of the sliding board body and in addition to prevent relative movements perpendicular to the longitudinal extension of the sliding board body, as can be taken from FIGS. 4 to 6 by way of example.

Figure 5:
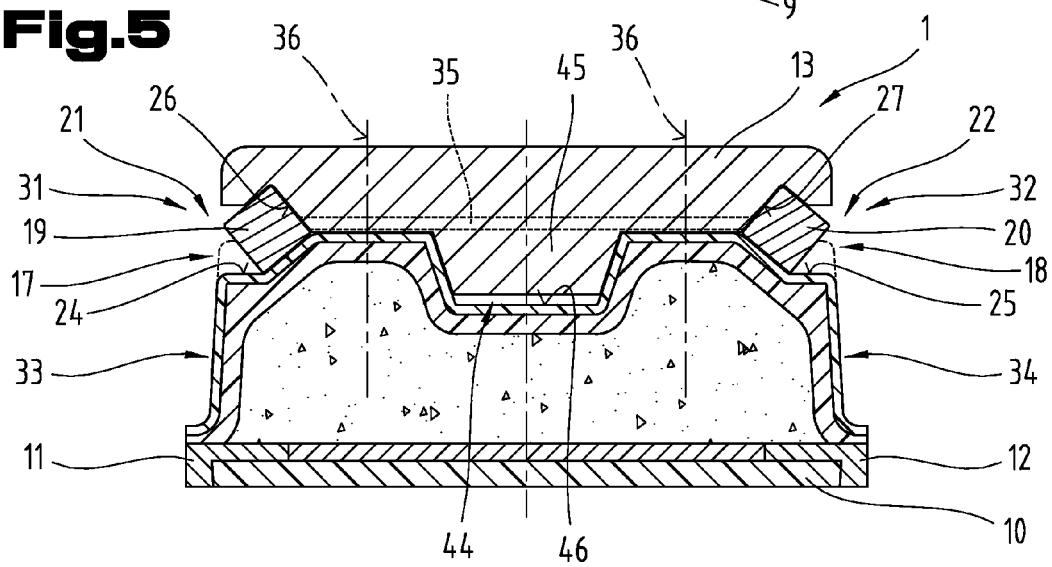
FIG. 5 shows a different embodiment for forming and interconnection between the overlying elements of a board-like sliding device by way of at least one coupling element.
Figure 6:
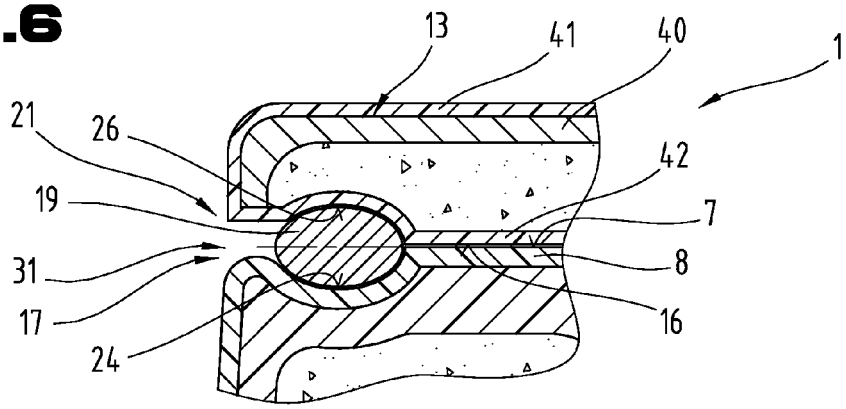
FIG. 6 shows a cut-out of a cross sectional view of an additional board-like sliding device with two layers.

As can also be taken from FIGS. 4 to 6, a lower part of the at least one coupling element 19, is mounted in at least one section corresponding, groove-like depression or cut-out 24, 25 of the sliding board body. Preferably, two opposite cut-outs 24, 25 or groove-like indentations are formed in the corner or edge sections 21, 22 of the sliding board body. The bottom part of the at least one coupling element 19, 20 is in this case mounted partially in such an at least partly corresponding cut-out 24, 25. An upper part section of the at least one coupling element 19, 20 engages at least partly in a groove-like depression or cut-out 26, 27 on the bottom side of the board-like force-transmitting element 13. This means that the at least one coupling element 19, 20 on the one hand is in interlocking connection with the force-transmitting element 13 and on the other hand is in interlocking connection with the sliding board body. Said interlocking connections are designed so that deviating movements between the board-like force-transmitting element 13 and the sliding board body are prevented as comprehensively as possible in a direction perpendicular to the longitudinal axis of the sliding board body and substantially parallel to the running surface coating 10.

The at least one profile or rod-like coupling element 19, 20 is preferably mounted by the mutual interconnection or by the cut-outs 24, 26 or 25, 27 between the board-like force-transmitting element 13 and the sliding board body. The additional securing of the at least one coupling element 19, 20 is thus not usually required. Perpendicular to the longitudinal axis of the sliding board body the at least one coupling element 19, 20 is fastened securely by at least one of the cut-outs 24 and/or 26 or 25 and/or 27. With regard to the longitudinal direction of the sliding board body the at least one coupling element 19, 20 is positioned preferably by at least one distal face wall or face delimitation, in particular by at least one face end 28, 28' or 29, 29' of the cut-out 24 and/or 26 or of the recess 25 and/or 27. In this way a certain amount of longitudinal displaceability of the at least one coupling element 19, can be provided in the longitudinal direction of the sliding board body. On at least one distal face end 28 or 28' of the cut-out 24 and/or 26 or on at least one distal face end 29, 29' of the cut-out 25 and/or 27 however a stop delimitation is formed with regard to the longitudinal displaceability of the at least one coupling element 19 or 20. This means that the at least one coupling element 19 or 20 is positioned stop-delimited at a face end 28, 28' or 29, 29' of the cut-out 24 and/or 26 or cut-out 25 and/or 27, whereby the undesirable removal or loss of the at least one coupling element 19 or 20 is prevented.

Alternatively or in combination with a stop-delimited longitudinal positioning or longitudinal delimitation of the at least one coupling element 19, 20 it is also possible, to adhere the at least one coupling element 19, 20 to the board-like force-transmitting element 13, in order to achieve a secure mounting of the structurally independent coupling element 19 or 20.

According to an advantageous embodiment the at least one interlocking coupling element 19, 20 can be connected by at least one snap connection 30 to the board-like force-transmitting element 13, such that the board-like force-transmitting element 13 and the assigned coupling element 19, 20 form a multipart, but one-piece unit. Said snap connection 30 is formed in a known manner by protruding or strip-like elevations and by corresponding depressions in order to produce an interconnecting snap connection 30. Furthermore, it is possible to form the interconnecting snap connection 30 by means of a mushroom or lamella-like elevation with associated undercuts or grooves.

According to an advantageous embodiment at least one free position 31, 32 is provided between the board-like force-transmitting element 13 and the sliding board body. This at least one free position 31, 32 runs in the longitudinal direction of the sliding board body and is formed in at least one longitudinal side edge area, in particular in the transitional section between the force-transmitting element 13 and the sliding board body, as can be taken by way of example from FIGS. 5, 6. By means of this at least one free position 31, 32 the at least one coupling element 19, 20 can be inspected or accessed from the side flanks or side walls 33, 34 of the sliding board body. In particular, at least one part of the at least one coupling element 19, 20 can be seen in normal projection on the side walls 33, 34 of the sliding board body at least in sections or partly.

The interlocking connection by means of the at least one coupling element 19, 20 in the transitional section between the board-like force-transmitting element 13 and the sliding board body is also useful in order to be able to mount or secure the at least one coupling element 19, 20 to be replaceable or exchangeable if necessary. In this way coupling elements 19, 20 with varying or if necessary adjusted mechanical strength, in particular with varying compressibility or shearing strength, are inserted between the board-like force-transmitting element 13 and the sliding board body. To achieve different or required characteristics of the snow sliding board, in particular the ski 2 or the snowboard, profile or strip-like coupling elements 19, 20 can be used which are made from different materials or compositions and thus have various different technical properties. In particular, by varying or exchanging at least one coupling element 19, 20 the bending resistance, hardness, sliding ability relative to the sliding board body or relative to the force-transmitting element 13, vibration damping, compressibility, tensile strength and elasticity or the like can be changed. As a result a simple and relatively quick adjustment can be made to adapt to the individual requirements or demands. In addition, by way of simple measures a greater range of models or types can be produced. For this only the use or implementation of a strip or profile-like coupling element 19, 20 with the desired technical features has to be considered. The various coupling elements 19, 20 can be made of plastic, in particular soft or hard plastic, such as for example rubber or polyethylene, various metals, fibre-reinforced plastic, carbon materials as well as any combination of materials.

According to an advantageous embodiment the various technical properties of a coupling element 19, 20 have different colours or can be distinguished from one another. In particular, the technical or mechanical property of various coupling elements 19, 20 is represented by suitably coloured markings. In this case coupling elements 19, 20 with light colour shades can represent bendy or pressure-sensitive coupling elements 19, 20, whereas coupling elements 19, 20 in dark shades for example can identify comparatively rigid or pressure-resistant coupling elements 19, 20.

It is expedient if the coupling elements 19, 20 extend approximately within the binding assembly 23. Independently of this the at least one coupling element 19, 20, which runs in at least one of the two upper edge sections 21, 22, can extend at least over 10% or up to 80% of the length of the sliding board body, in order to achieve good lateral guiding or lateral stability between the board-like force-transmitting element 13 and the sliding board body. Furthermore, it is possible in at least one upper edge section 21, 22 of the sliding board body to provide at least two coupling elements 19 or 20 arranged behind one another, wherein said coupling elements can be arranged in a row next to one another without any gap or can be formed in spaced apart sections, for example underneath the jaw bodies of the binding device 3.

To achieve high transverse stability between the board-like force-transmitting element 13 and the sliding board body, the at least one coupling element 19, 20 can have a polygonal cross sectional shape. In particular, the at least one coupling element 19, 20 according to the view in FIG. 4 can be designed to be L-shaped in cross section for example, or according to the view in FIG. 5 can be rectangular in cross section for example or can also have a triangular or dovetail shaped cross section.

According to the view in FIG. 6 it is also possible that the at least one coupling element 19, has a round cross section, in particular a circular or elliptical cross section.

As can also be taken from the drawing in FIG. 5 opposite coupling elements 19, 20 that are substantially parallel to one another can be joined by means of at least transverse web 35 to form a one-piece unit. In this way the handling or assembly and storage are simplified and the two essentially parallel coupling elements 19, 20 can be mounted reliably at the desired reference distance from one another.

The respective coupling elements 19, 20 have within their longitudinal extension preferably a constant or almost uniform cross-sectional geometry or cross-sectional dimension. This means that the coupling elements 19, 20 can be formed by strip or rod-like elements. In particular, the coupling elements 19, 20 can be formed by individually cut profile elements, which are cut from an extruded bar or continuous material. The respective length of said coupling elements 19, 20 thus has a suitable influence on the characteristics of the sliding device 1. The ends or end sections can thus be subjected if necessary to simple shaping or subsequent deformation. In particular, when using hollow-profiled coupling elements 19, 20 the ends can be closed.

The average structural height or thickness of the board-like force-transmitting element 13 is between 0.5 to 3 cm. In particular, the thickness of the multi-layered, board-like force-transmitting element 13 is between 50% and 150% of the thickness of the sliding board body within the binding assembly zone. In the advantageous embodiment shown in FIG. 4 the structural height or thickness of the board-like force-transmitting element 13 corresponds approximately to the structural height or thickness of the sliding board body within the same cross sectional plane, in particular within the binding assembly zone. The total thickness or total height of the sliding device 1 consisting of the board-like force-transmitting element 13 and the actual sliding board body within the binding assembly area, as illustrated by way of example in FIG. 4, is a maximum of 6 cm, preferably 2 to 3 cm. This relatively low structural height of the sliding device 1 which still has suitable strength and rigidity in practice is mainly achieved by the multi-layered, board-like load-transmitting body, in particular by the board-like force-transmitting element 13, which is coupled via at least one interlocking coupling element 19, 20 to the actual sliding board body in a form-overlapping manner.

In the operation-ready state of the sliding device 1—FIG. 3—a binding device 3 is mounted on the top side of the board-like force-transmitting element 13. Screwing means for the direct or indirect securing of the binding device 3 are anchored solely in the board-like force-transmitting element 13. The board-like force-transmitting element 13 however is connected by means of separately designed connecting means 36 within connecting zones 37 to the actual sliding board body to be resistant to abrasion—but still elastically compliant, as explained in detail in the following. Preferably, at a single point or within a relatively short longitudinal section, which is/are preferably in the region of the binding assembly centre point 15, the board-like force-transmitting element 13 is connected via at least one screw in a rigid or stationary manner to the sliding board body, as illustrated schematically in FIG. 1. In the opposite end sections mounted to slide freely relative to the underlying sliding board body the board-like force transmitting-element 13 remains movable relative to the sliding board body in its longitudinal direction.

As also indicated schematically in FIGS. 1 and 3, the board-like force-transmitting element 13 is connected to the sliding board body via a plurality of connecting means 36 spaced apart from one another in longitudinal direction within the corresponding connecting zones 37, such that the lifting or detachment of the board-like force-transmitting element 13 from the top side 7 of the sliding board body is prevented. In the immediate vicinity of the jaw bodies of the binding device 3 screwing means can also be provided, which connect the board-like force-transmitting element 13 via longitudinal holes, which are aligned parallel to the longitudinal direction of the force-transmitting element 13, to the underlying sliding board body, such that various different bending or chord lengths can be balanced without any hindrance as far as possible between the said components.

From the view according to FIGS. 1 and 3 it can also be seen that the sliding device 1 comprises at least two components supporting the user, in particular the board-like force-transmitting element 13 and the sliding board body arranged underneath. The board-like sliding device 1 is thus designed to consist of at least two parts or multiple parts, whereby the said components are coupled together by interlocking connections and/or screw connections.

Figure 2:
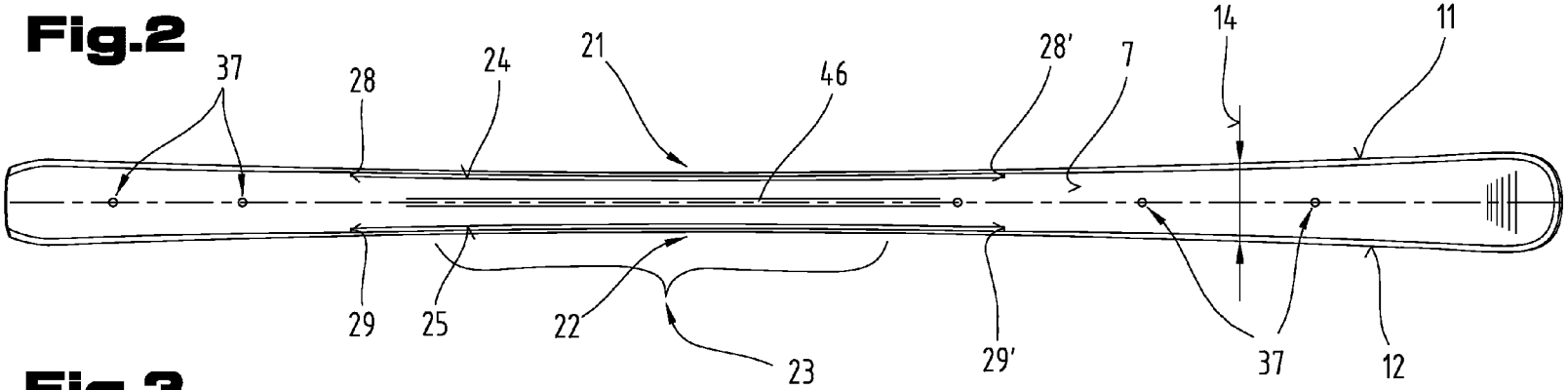
FIG. 2 shows the ski body according to FIG. 1 in plan view.

As can best be taken from an overview of FIGS. 1 to 3, the board-like force-transmitting element 13 is connected to the sliding board body on or in a plurality of connecting zones 37 spaced apart from one another in the longitudinal direction of the board-like force-transmitting element 13. The number of connecting zones 37 depends essentially on the total length of the board-like force-transmitting element 13 and on its strength or rigidity. In the shown exemplary embodiment seven connecting zones 37 are provided, by means of which the board-like force-transmitting element 13, which depending on the length of the underlying sliding board body can have a length of about 80 cm to about 180 cm, is connected to a sliding board body with a suitably adjusted, i.e. at least slightly longer length. Preferably, at least four connecting zones 37 are provided. The individual connecting zones 37 are positioned at a distance of about 15 cm to 30 cm in longitudinal direction of the board-like force-transmitting element 13. The distance between the individual connecting zones 37 can also vary in longitudinal direction of the force-transmitting element 13, in particular can be reduced in the direction of the end sections to about 15 cm, in order to achieve an optimum interaction between the board-like force-transmitting element 13 and the sliding board body. In at least one of these connecting zones 37 the board-like force-transmitting element 13 and the sliding board body are joined together in an abrasion-resistant manner and non-detachably, so that the lifting of the board-like force-transmitting element 13 relative to the top side 7 of the sliding board body is prevented.

It is essential in this case that inside at least one connecting zone 37 there is an elastically flexible connecting means 36, which provides an elastically flexible connection between the board-like force-transmitting element 13 and the sliding board body. The at least one elastically flexible connecting means 36 is designed so that it opposes relative displacements between the board-like force-transmitting element 13 and the sliding board body caused by bending and/or rebounding of the sliding board body by means of elastically flexible and spring elastically restoring resistance. Such an elastically flexible connecting means 36 is arranged at least in the opposite end sections of the board-like force-transmitting element 13, as illustrated by way of example in FIG. 1. Of course, it is also possible, in all of the connecting zones 37 to provide an elastically flexible connecting means 36 to form an elastically flexible and spring-elastic restoring connection between the board-like force-transmitting element 13 and the sliding board body.

According to an advantageous embodiment the elastically flexible compound means 36 comprises at least one elastomeric damping element 39 mounted in an opening 38 of the board-like force-transmitting element 13, as illustrated schematically in FIG. 3. Said elastomeric damping element 39 is penetrated by a fastening screw for non-removable connection between the board-like force-transmitting element 13 and the sliding board body. The elastomeric damping element 39 is dimensioned, and the fastening screw is positioned relative to the damping element 39, such that a section of the elastomeric damping element 39 lies with regard to the longitudinal direction of the board-like force-transmitting element 13 at least in front of and behind the fastening screw. Preferably, the material of the elastomeric damping element 39 is provided in a circle around the shaft of the fastening screw. Alternatively or in combination with this, it is also possible however, with regard to the longitudinal direction of the board-like force-transmitting element 13, to allow the board-like force-transmitting element 13 to bear left and right on the shaft of the fastening screw or to be supported so as to slide relative to the shaft of the fastening screw. In this case the opening 38 is formed in the board-like force-transmitting element 13 as an elongated hole, wherein the width of said longitudinal hole corresponds approximately to the diameter of the shaft of the fastening screw. The optional or combined design of an opening 38 in the board-like force-transmitting element 13 is illustrated in the form of an elongated hole in the drawing according to FIG. 3 by way of example.

Like the sliding board body the board-like force-transmitting element 13 can also be designed as a multi-layered composite body, in particular a so-called sandwich-compound element. This means that the board-like force-transmitting element 13 is formed by a plurality of adhesively joined layers and like the actual sliding board body is produced by means of a heating press in a heating press process, as known for the production of skis and snowboards or the like.

In particular the board-like force-transmitting element 13 in its function as a relatively large stabilising or damping means—FIG. 1—comprises at least one strength-related upper strap 40 and at least one cover layer 41 decorated to be decorated on one side over the strength-related upper strap 40, as can be seen in FIG. 6. The bottom side 16 of the board-like force-transmitting element 13 is preferably made from a sliding layer 42 made of plastic or the bottom side 16 of the board-like force-transmitting element 13 is preferably designed as a sliding layer 42. Said sliding layer 42 compared to the top side 7 of the cover layer 8 of the sliding board body—FIG. 6—has a reduced frictional resistance or one that is as low as possible. In addition, the sliding layer 42 is designed to as resistant to abrasion as possible relative to the cover layer 8. The sliding layer 42 on the bottom side 16 of the board-like force-transmitting element 13 can thus be formed by a thermoplastically deformable plastic layer, which has similar properties to the surface or cover layer 8 of the sliding board body or similar properties to the running surface coating 10—FIG. 5—of the sliding board body. The sliding layer 42 or the bottom side 16 of the board-like force-transmitting element 13 can however also be formed by the lower strap of the board-like force-transmitting element 13. This is mainly when the lower strap is formed by a so-called prepreg, i.e. by a fabric impregnated with thermosetting plastic resin.

The cover layer 41 of the board-like force-transmitting element 13, which is decorated or has to be decorated on the bottom side and/or the outside, extends in addition to the formation of the upper cover surface of the board-like force-transmitting element 13 preferably at least over sections of the longitudinal side walls or the so-called side cheeks of the board-like force-transmitting element 13, as illustrated by way of example in FIG. 6.

At least the main proportion of individual layers or elements of the multi-layered, board-like force-transmitting element 13 are shaped and bonded by means of a heating press, in particular in at least one heating press procedure for the various layers or elements placed in a heated press form into a one-piece, multi-layered composite body.

The sandwich-like structure of the multi-layered composite body produces a board-like force-transmitting element 13, which achieves a relatively high torsion or twisting resistance and also thrust resistance. The board-like force-transmitting element 13 is in this case considerably influential on the bending behaviour or the distribution of bending resistance of an assembled, ready-to-use sliding device 1, in particular a suitably designed alpine or carving ski 2, as shown by way of example in FIG. 3.

The performance that can be achieved by means of a ski 2 or snowboard according to the invention is thus relatively high. In particular, the track guiding or control of the said ski 2 or snowboard is significantly improved and influenced positively. Furthermore, high quality guiding, in particular track stability and predictable curve behaviour can be ensured for the user of the given sliding device.

It can be seen from FIG. 4, that the board-like force-transmitting element 13 on the top side 7 of the sliding board body is supported in a load-transmitting manner. The top side of the board-like force-transmitting element 13 is used for mounting or securing a binding device 3—FIG. 1—or a rail arrangement 43 for the longitudinal displaceable mounting or support of the jaw bodies of a binding device 3, as known from the prior art in many different embodiments.

If necessary, between the bottom side 16 of the board-like force-transmitting element 13 and the top side 7 of the sliding board body an additional interlocking connection 44 is provided. Said interlocking connection 44 extends preferably congruently to the longitudinal middle axis of the sliding board body and comprises at least one strip-like elevation 45, which cooperates with a corresponding, groove-like depression 46. The at least one depression 46 is preferably formed in the top side 7 of the sliding board body and interlocks with a corresponding elevation 46 on the bottom side 16 of the board-like force-transmitting element 13, as can best be seen from FIG. 4 or FIG. 5. Also by means of said interlocking connection 44, which is formed in this case without structurally independent interlocking means, relative displaceability in the longitudinal direction of the sliding board body can be allowed, but a deviating movement between the board-like force-transmitting element 13 and the sliding board body at right angles to the longitudinal direction of the sliding board body can be prevented.

The exemplary embodiments show possible embodiment variants of snow sliding board, in particular a ski 2 or a snowboard, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the structure of the various components, the latter and its components have not been represented true to scale in part and/or have been enlarged and/or reduced in size.

The problem forming the basis of the independent solutions according to the invention can be taken from the description.

Mainly the individual embodiments shown in FIGS. 1-4; 5; 6 can form the subject matter of independent solutions according to the invention. The objectives and solutions according to the invention relating thereto can be taken from the detailed descriptions of these figures.

LIST OF REFERENCE NUMBERS

1. Sliding device
2. Ski
3. Binding device
4. Upper strap
5. Lower strap
6. Core
7. Top side
8. Cover layer
9. Bottom side
10. Running face coating
11. Control edge
12. Control edge
13. Force-transmitting element
14,14' Width Binding assembly-centre
15. point
16. Bottom side
17. Coupling means
18. Coupling means
19. Coupling element
20. Coupling element
21. Edge section
22. Edge section
23. Binding assembly zone
24. Cut-out
25. Cut-out
26. Cut-out
27 Cut-out
28, 28' Face end
29, 29' Face end
30. Snap connection
31. Free position
32. Free position
33. Side wall
34. Side wall
35. Transverse web
36. Connecting means
37. Connecting zone
38. Opening
39. Damping element
40. Upper strap
41. Cover layer
42. Sliding layer
43. Rail arrangement
44. Interlocking connection
45. Elevation
46. Depression

The invention claimed is:

1. A Ski or snowboard in the form of a board-like sliding device, comprising a multi-layered sliding board body including at least of at least one strength-related upper strap, at least one strength-related lower strap, at least one core arranged in between the latter, at least one cover layer forming a top side of the sliding board body, and at least one running surface coating forming a bottom side of the sliding board body, and with at least one board-like force-transmitting element supported on the top side of the sliding board body, the top side of which is provided for supporting a binding device for a potentially releasable connection with a sports shoe, wherein between the bottom side of the board-like force-transmitting element and the top side of the sliding board body at least one interlocking coupling is formed in at least one of two lateral upper edge sections running in the longitudinal direction of the sliding board body, the at least one interlocking coupling comprising at least one physically independent strip or profile-like coupling element arranged between the board-like force-transmitting element and the sliding board body, wherein the between the board-like force-transmitting element and the sliding board body a free position is formed, via which the at least one coupling element can be inspected or accessed from the side walls of the sliding board body.

2. The ski or snowboard according to claim 1, wherein the at least one structurally independently designed coupling element is embedded at least partly in an interlocking manner between the bottom side of the force-transmitting element and the top side of the sliding board body and for the mutual guiding between the board-like force-transmitting element and the sliding board body in longitudinal direction of the sliding board body and is designed for preventing relative movements transversely to the longitudinal axis of the sliding board body.

3. The ski or snowboard according to claim 1, wherein a lower part section of the at least one coupling element lies in a corresponding, groove-like depression or cut-out on the sliding board body and interconnects with its upper part section in a groove-like depression or cut-out of the board-like force-transmitting element.

4. The ski or snowboard according to claim 1, wherein the at least one coupling element is adhered to the board-like force-transmitting element.

5. The ski or snowboard according to claim 1, wherein the at least one coupling element can be connected via a snap connection to the board-like force-transmitting element.

6. The ski or snowboard according to claim 1, wherein the at least one coupling element is mounted and secured solely by an interlocking coupling between the board-like force-transmitting element and the sliding board body.

7. The ski or snowboard according to claim 1, wherein the at least one interlocking coupling comprises a plurality of interlocking couplings having different compressive strength or shearing resistance characteristics can be replacably arranged between the board-like force-transmitting element and the sliding board body.

8. The ski or snowboard according to claim 7, wherein the different technical properties of a coupling element are represented or characterised by coupling elements of different colours.

9. The ski or snowboard according to claim 1, wherein the at least one interlocking coupling comprises a plurality of interlocking couplings the designed to have substantially uniform cross-sectional dimensions, but are made from various different materials and thus have various different technical properties, including relating to bending resistance, sliding ability relative to the sliding board body or relative to the force-transmitting element, vibration damping properties, compressibility, tensile strength, and/or elasticity and if necessary can be mounted between the board-like force-transmitting element and the sliding board body.

10. The ski or snowboard according to claim 1, wherein the at least one coupling element extends at least inside a binding assembly zone.

11. The ski or snowboard according to claim 1, wherein the at least one coupling element extends over 10% to 80% of the length of the sliding board body.

12. The ski or snowboard according to claim 1, wherein the at least one coupling element has a polygonal cross sectional shape.

13. The ski or snowboard according to claim 1, wherein the at least one coupling element has a round cross sectional shape.

14. The ski or snowboard according to claim 1, wherein in both, lateral, longitudinal, upper edge sections of the sliding board body at least one coupling element is arranged respectively.

15. The ski or snowboard according to claim 14, wherein opposite, substantially parallel coupling elements are connected to one another by means of at least one transverse web to form a one-piece unit.

16. The ski or snowboard according to claim 1, wherein the board-like force-transmitting element is connected to the sliding board body via a plurality of connecting zones spaced apart from one another in the longitudinal direction of the board-like force-transmitting element.

17. The ski or snowboard according to claim 16, wherein in at least one connecting zone an elastically flexible connecting means is formed in longitudinal direction of the sliding board body.

* * * * *